US008200134B2

(12) United States Patent
Hamahashi et al.

(10) Patent No.: US 8,200,134 B2
(45) Date of Patent: Jun. 12, 2012

(54) DOUBLE-SIDED ONE PASS IMAGE FORMING APPARATUS

(75) Inventors: Shunsuke Hamahashi, Osaka (JP); Toshikane Nishii, Osaka (JP); Kohta Sakaya, Osaka (JP); Makoto Matsushita, Osaka (JP); Yoshitaka Sekiguchi, Hyogo (JP); Masayuki Hayashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 577 days.

(21) Appl. No.: 12/352,076

(22) Filed: Jan. 12, 2009

(65) Prior Publication Data

US 2009/0190949 A1 Jul. 30, 2009

(30) Foreign Application Priority Data

Jan. 25, 2008 (JP) ..... 2008-015487

(51) Int. Cl.
*G03G 15/01* (2006.01)

(52) U.S. Cl. ..... 399/302

(58) Field of Classification Search ..... 399/49, 399/302, 308, 315, 316, 323
See application file for complete search history.

(56) References Cited

U.S. PATENT DOCUMENTS

| | | | | |
|---|---|---|---|---|
| 2002/0122679 | A1* | 9/2002 | Omata et al. | 399/309 |
| 2006/0159480 | A1* | 7/2006 | Mima et al. | 399/82 |
| 2007/0041756 | A1* | 2/2007 | Akaike et al. | 399/310 |
| 2007/0172257 | A1* | 7/2007 | Matsuda et al. | 399/167 |
| 2007/0212141 | A1 | 9/2007 | Hamahashi | |
| 2007/0253753 | A1* | 11/2007 | Yamaji et al. | 399/302 |
| 2007/0297817 | A1* | 12/2007 | Bessho | 399/27 |
| 2008/0048392 | A1 | 2/2008 | Hamahashi | |

FOREIGN PATENT DOCUMENTS

| | | |
|---|---|---|
| JP | 2-259670 | 10/1990 |
| JP | 9-211900 | 8/1997 |
| JP | 2002-189358 | 7/2002 |

* cited by examiner

*Primary Examiner* — David Gray
*Assistant Examiner* — Ruth Labombard
(74) *Attorney, Agent, or Firm* — Oblon, Spivak, McClelland, Maier & Neustadt, L.L.P.

(57) ABSTRACT

An image forming apparatus enables a high-quality double-side printing of a transfer medium by one-pass method using a simple structure. A latent image is formed and developed on an image carrier (drum) in a process cartridge. A resultant toner image is transferred by a first transfer unit (roller) onto either an upper surface of the transfer medium or a first intermediate transfer body (roller) in a first transfer area. The toner image on the first intermediate transfer body is transferred onto a back surface of the transfer medium in a fourth transfer area via a second intermediate transfer body (belt) and a third intermediate transfer body (roller). The fourth transfer area is located downstream of the first transfer area along a transport path of the transfer medium.

16 Claims, 4 Drawing Sheets

DOUBLE-SIDED ONE PASS IMAGE FORMING APPARATUS

BACKGROUND OF THE INVENTION

1. Field of the Invention

The present invention generally relates to image forming apparatuses.

2. Description of the Related Art

In conventional image forming apparatuses of the electrophotography type, a switch-back system and a one-pass system are known, both referring to different methods for forming an image on both sides of a transfer medium, such as a sheet of paper, "copy paper", and so on.

In the switch-back system, first an image is formed on one side (such as the front side) of the transfer medium by a transfer unit, and then the transferred image is fused on the transfer medium by a fusing unit. The transfer medium is then inverted and switched back so that another image can be transferred and fused on the other side (such as the back side) of the transfer medium.

In the one-pass system, after an image is transferred onto both sides of a transfer medium by a double-side transfer unit, the transfer medium is passed through the fusing unit. Thus the image is formed on both sides of the transfer medium without the transfer medium being inverted and switched back.

The one-pass system is superior to the switch-back system in the following respects. For one thing, the one-pass system does not require the complex switch-back mechanism for inverting and switching back the transfer medium, with the associated increase in cost. For another, the one-pass system can avoid the long time required by the switch-back system for image formation. For still another, the one-pass system can avoid the jamming of the transfer medium that may occur when the transfer medium is curled by the heat from the initial fusing unit before it is switched back for printing the back side.

Examples of such image forming apparatus of the one-pass type for double-sided printing that do not require an inverting mechanism or a double-sided transport path are disclosed in the following documents.

Patent Document 1: Japanese Laid-Open Patent Application No. 2002-189358

Patent Document 2: Japanese Laid-Open Patent Application No. 2-259670

Patent Document 3: Japanese Laid-Open Patent Application No. 9-211900

Patent Document 1 discusses an image forming apparatus with a first and a second intermediate transfer belt. The second intermediate transfer belt is capable of transporting a transfer medium, such as a printing paper, and also transferring a toner image onto the first intermediate transfer belt.

Patent Document 2 discusses an image forming apparatus that transfers a toner image onto both sides of a transfer paper using a pair of photosensitive drums for individually forming toner images having mutually different charge polarities.

Patent Document 3 discusses an image forming apparatus that forms a toner image on both sides of a transfer paper using individual intermediate transfer belts for retaining a back surface image of individual colors, and a contacting/separating mechanism for bringing each transfer belt into and out of contact with a photosensitive drum.

These image forming apparatuses of the one-pass type, however, still have room for improvement in image formation speed, size, price, image quality, and so on.

For example, in the image forming apparatus according to Patent Document 1, after a toner image for the back surface is transferred onto the second intermediate transfer belt, a transfer medium is transported on the second intermediate transfer belt with the transferred toner image thereon. As a result, the transfer medium may rub against the toner image of the back surface on the intermediate transfer belt, thus causing an image quality defect. Further, the toner image needs to be transported for the lengths of the two intermediate transfer belts before the image is transferred onto the back surface of the transfer medium, resulting in a long print time.

The image forming apparatus according to Patent Document 2 requires a pair of photosensitive drums and developing units for forming a toner image on each of the front and back surfaces, with the resultant increase in the number of components, cost, and size of the apparatus.

The image forming apparatus according to Patent Document 3 requires four intermediate transfer belts for the colors of K (black), M (magenta), C (cyan), and Y (yellow), with an increase in the number of components, cost, and size of the apparatus. In addition, color matching adjustment is difficult.

SUMMARY OF THE INVENTION

It is a general object of the present invention to provide an image forming apparatus capable of forming a high-quality image on both sides of a transfer medium in the one-pass method with a simple structure.

According to one aspect of the present invention, an image forming apparatus includes a latent image forming unit configured to form a latent image on an image carrier; a developing unit configured to develop the latent image on the image carrier to form a toner image; a first transfer unit configured to transfer the toner image on the image carrier onto a front side of a transfer medium or onto a first intermediate transfer body in a first transfer area; a second transfer unit configured to transfer the toner image on the first intermediate transfer body onto a second intermediate transfer body in a second transfer area; a third transfer unit configured to transfer the toner image on the second intermediate transfer body onto a third intermediate transfer body in a third transfer area; a fourth transfer unit configured to transfer the toner image on the third intermediate transfer body onto a back surface of the transfer medium in a fourth transfer area.

Each of the first intermediate transfer body and the third intermediate transfer body may include a roller, and the second intermediate transfer body may include a belt.

The fourth transfer area is located downstream of the first transfer area along a transport path of the transfer medium.

In a preferred embodiment, the image forming apparatus may include a transfer aiding unit disposed between one first transfer area and another first transfer area, and/or between the first transfer area and the fourth transfer area, the transfer aiding unit being configured to aid the transport of the transfer medium along the transport path.

In another preferred embodiment, the image forming apparatus may include a separating unit configured to separate the transfer medium from the fourth transfer unit.

In another preferred embodiment, the image forming apparatus may include a pre-fusing unit disposed between the first transfer unit and the fourth transfer unit along the transport path of the transfer medium.

In another preferred embodiment, the fourth transfer unit may include a contactless transfer unit.

In another preferred embodiment, the image forming apparatus may include a cleaning device configured to clean the first intermediate transfer body from which the toner image is transferred onto the second intermediate transfer body by the second transfer unit.

In another preferred embodiment, the image forming apparatus may include a cleaning device configured to clean the second intermediate transfer body from which the toner image is transferred onto the third intermediate transfer body by the third transfer unit.

In another preferred embodiment, the image forming apparatus may include a cleaning device configured to clean the third intermediate transfer body from which the toner image is transferred onto the transfer medium by the fourth transfer unit.

In yet another embodiment, the image forming apparatus may include a separating unit configured to separate the second intermediate transfer body from the first intermediate transfer body and the third intermediate transfer body.

In yet another embodiment, the image forming apparatus may include a toner image detection unit configured to detect a density and a transfer position of the toner image transferred onto the second intermediate transfer body.

In another embodiment, the image forming apparatus may include a memory unit configured to store a maximum length of the transfer medium onto which the toner image can be transferred in the case of double-sided printing.

The maximum length of the transfer medium may be determined by a difference between a transport distance of the toner image from the first transfer area to the fourth transfer area via the second transfer area and the third transfer area, and a transport distance of the transfer medium between the first transfer area and the fourth transfer area along the transport path of the transfer medium.

BRIEF DESCRIPTION OF THE DRAWINGS

These and other objects, features and advantages of the invention will be apparent to those skilled in the art from the following detailed description of the invention, when read in conjunction with the accompanying drawings in which.

DETAILED DESCRIPTION OF THE PREFERRED EMBODIMENTS

Preferred embodiments of the present invention are described with reference to the drawings. First, a description is given of a basic structure of an image forming apparatus according to an embodiment.

Figure 1:
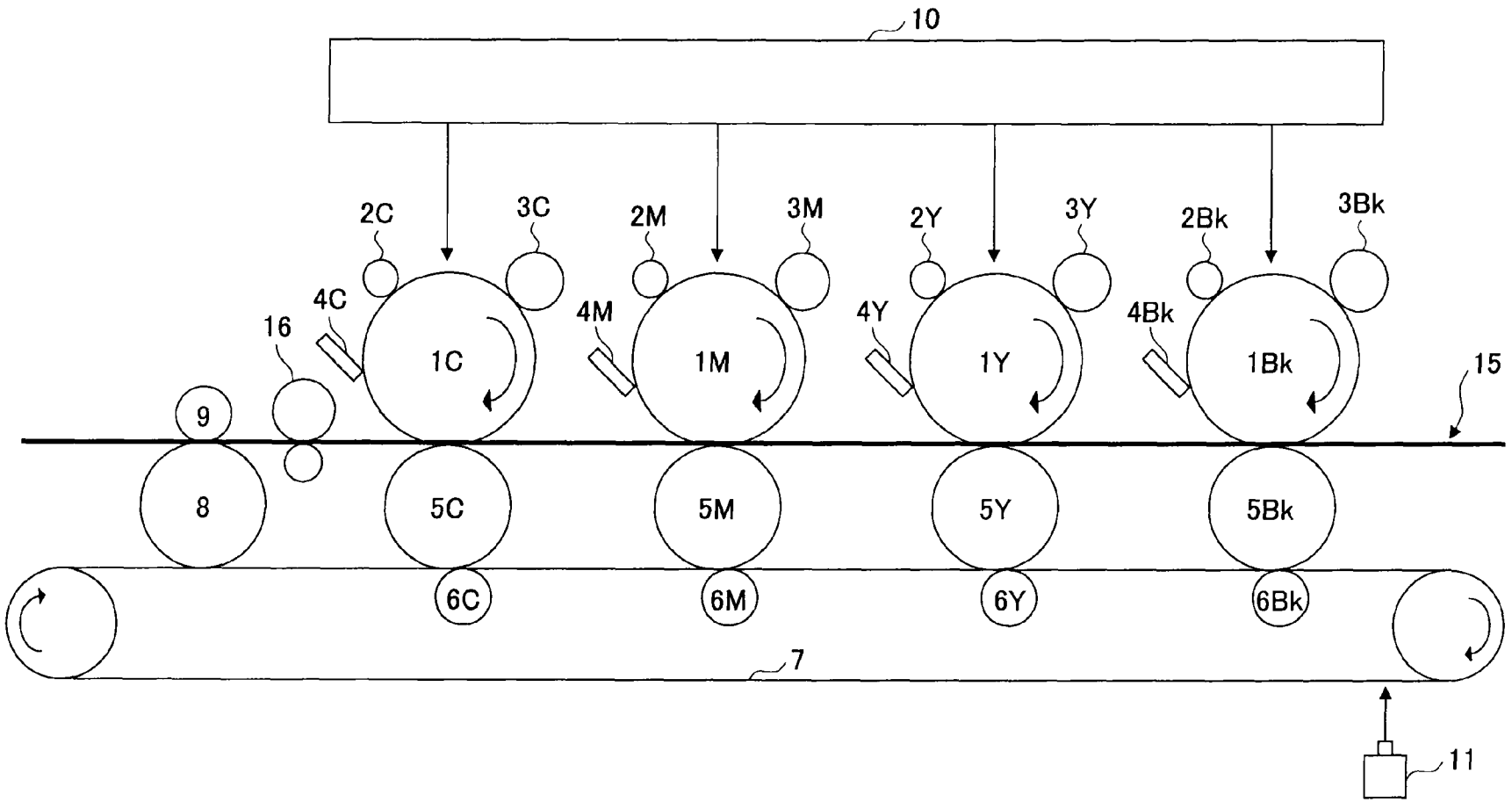
FIG. 1 shows a schematic diagram of an image forming apparatus according to an embodiment of the present invention.

FIG. 1 shows a schematic diagram of an image forming apparatus according to the present embodiment. The image forming apparatus includes four process cartridges for forming toner images of black (Bk), yellow (Y), magenta (M), and cyan (C). Each of the process cartridges includes a photosensitive drum 1Bk, 1Y, 1M, or 1C, which is an image carrier. Although these process cartridges use a toner of the different colors Bk, Y, M, and C as an image forming substance, they have the same basic structure. The process cartridges can be replaced at the end of their life.

In other embodiments, the image forming apparatus may be configured for a single color, two colors, three colors, or five or more colors.

The process cartridge is described with reference to a Bk toner image as an example. The process cartridge for Bk includes the photosensitive drum 1Bk (image carrier); a charging device 2Bk; a developing device 3Bk (developing unit); and a drum cleaning device 4Bk.

The photosensitive drum 1Bk may include an aluminum cylinder with a diameter ranging from 25 to 100 mm. The cylinder may be coated with a surface layer of an organic semiconductor as a photoconductive substance. Alternatively, the cylinder may be coated with a surface layer of amorphous silicon. In another embodiment, the image carrier may be belt-shaped.

The charging device 2Bk, which may include a charging roller, is configured to charge the surface of the photosensitive drum 1Bk uniformly as the photosensitive drum 1Bk is rotated in the clockwise direction in the drawing by a drive unit (not shown). The uniformly charged surface of the photosensitive drum 1Bk is then scanned by laser light emitted by an exposure device 10, which is a latent image forming unit, whereby the surface is exposed and an electrostatic latent image for Bk is formed on the photosensitive drum 1Bk.

The electrostatic latent image for Bk is developed into a Bk toner image by the developing device 3Bk using the Bk toner. The Bk toner image developed on the photosensitive drum 1Bk is transferred onto either the front side of a transfer medium by a first transfer roller 5Bk as a first transfer unit, or onto the transfer roller 5Bk as a first intermediate transfer body for a primary transfer. The transfer medium is transported along a transport path 15.

The area where the Bk toner image is transferred by, or onto, the first transfer roller 5Bk is referred to as a first transfer area. Whether the Bk toner image is transferred onto the upper surface of the transfer medium by the first transfer roller 5Bk, or onto the first transfer roller 5Bk as the first intermediate transfer body for the primary transfer, is determined by whether the transfer medium is present in the first transfer area where the toner image is transferred.

The drum cleaning device 4Bk removes residual toner on the surface of the photosensitive drum 1Bk after the transfer of the Bk toner image in the first transfer area. The residual toner recovered by the drum cleaning device 4Bk may be returned to the developing device 3Bk for reuse.

A neutralizing device (not shown) may be provided to neutralize a residual charge on the photosensitive drum 1Bk after removal of the residual toner. By such neutralization, the surface of the photosensitive drum 1Bk can be initialized for the next round of image formation.

In the other process cartridges for Y, M, and C, the Y, M, or C toner image is similarly formed on the photosensitive drum 1Y, 1M, or 1C and then transferred onto the front side of the transfer medium or the first transfer roller 5Y, 5M, or 5C as the first intermediate transfer body.

An exposure/scan control signal may be generated by an image data processing apparatus (not shown) based on an image information signal which may be sent from a personal computer. Such exposure scan control signal may be sent to the exposure device 10. The exposure device 10, which is the latent image forming unit, generates laser light based on the exposure scan control signal, with which laser light the photosensitive drums 1Bk, 1Y, 1M, and 1C in the individual process cartridges are irradiated. As a result, the photosensitive drums 1Bk, 1Y, 1M, and 1C are exposed, forming an electrostatic latent image for Bk, Y, M, or C thereon.

More specifically, the exposure device 10 may be configured to irradiate the photosensitive drums 1Bk, 1Y, 1M, and 1C with the laser light emitted by a light source, while scanning each photosensitive drum using a polygon mirror rotated by a motor, via plural optical lenses or mirrors. Instead of the aforementioned exposure device 10 emitting laser light, an exposure unit configured to emit light from an LED array may be employed.

Below the photosensitive drums 1Bk, 1Y, 1M, and 1C, there are disposed the first transfer rollers 5Bk, 5Y, 5M, and 5C, each of which functions as the first transfer unit and also as the first intermediate transfer body. The first transfer rollers 5Bk, 5Y, 5M, and 5C are disposed in contact with the photosensitive drums 1Bk, 1Y, 1M, and 1C, respectively, so that the first transfer rollers rotate in a driven manner.

As mentioned above, the area of contact between each of the first transfer rollers 5Bk, 5Y, 5M, and 5C and each of the photosensitive drums 1Bk, 1Y, 1M, and 1C, respectively, forms the first transfer area where a primary nip is formed. In the image forming apparatus according to the present embodiment, the first transfer rollers 5Bk, 5Y, 5M, and 5C are supplied with a primary transfer bias of the opposite polarity to that of the toner on the photosensitive drums 1Bk, 1Y, 1M, and 1C. Alternatively, a charger system using the discharge of an electrode may be employed.

Each of the four first transfer rollers 5Bk, 5Y, 5M, and 5C is in contact with a transfer belt 7, which is a second intermediate transfer body, that moves endlessly. The area of contact between the first intermediate transfer body (i.e., the first transfer rollers 5Bk, 5Y, 5M, and 5C) and the second intermediate transfer body (i.e., the transfer belt 7) forms a second transfer area. In each of the second transfer areas, a second transfer roller 6Bk, 6Y, 6M, or 6C is disposed, corresponding to the first transfer roller 5Bk, 5Y, 5M, or 5C, respectively, via the transfer belt 7.

Thus, each of the four first transfer rollers 5Bk, 5Y, 5M, and 5C and each of the second transfer rollers 6Bk, 6Y, 6M, and 6C, respectively, form a secondary transfer nip portion. The transfer belt 7 rotates in contact with the first transfer rollers 5Bk, 5Y, 5M, and 5C in a driven manner.

In the image forming apparatus of the present embodiment, the back surface (the inner surface of the loop) of the transfer belt 7 is supplied with a secondary transfer bias with the opposite polarity to that of the toner on the first transfer rollers 5Bk, 5Y, 5M, and 5C. Alternatively, a charger system using the discharge of an electrode may be employed.

The toner image on the photosensitive drum 1Bk, 1Y, 1M, or 1C is transferred onto the front side of the transfer medium as follows. While the transfer medium is transported along the transport path 15, the Bk, Y, M, and C toner images formed on the photosensitive drums 1Bk, 1Y, 1M, and 1C are transferred onto the front side of the transfer medium successively one color upon another in the respective first transfer areas for the photosensitive drums 1Bk, 1Y, 1M, and 1C by adjusting the primary transfer bias to the primary transfer rollers 5Bk, 5Y, 5M, and 5C. Thus, a toner image of four overlaid colors (hereafter referred to as a "four-color toner image") is formed on the front side of the transfer medium.

On the other hand, a toner image is transferred onto the back side of the transfer medium as follows. First, Bk, Y, M, and C toner images for the back side formed on the four photosensitive drums 1Bk, 1Y, 1M, and 1C are primarily transferred onto the first transfer rollers 5Bk, 5Y, 5M, and 5C functioning as the first intermediate transfer body in the respective first transfer areas, by adjusting the primary transfer bias to the first transfer rollers. At this time, the transfer medium is not transported along the transport path 15.

The toner image of each color primarily transferred onto the first transfer rollers 5Bk, 5Y, 5M, and 5C is further transferred onto the transfer belt 7 in the second transfer areas by the second transfer rollers 6Bk, 6Y, 6M, and 6C (i.e., the second intermediate transfer body).

Figure 2:
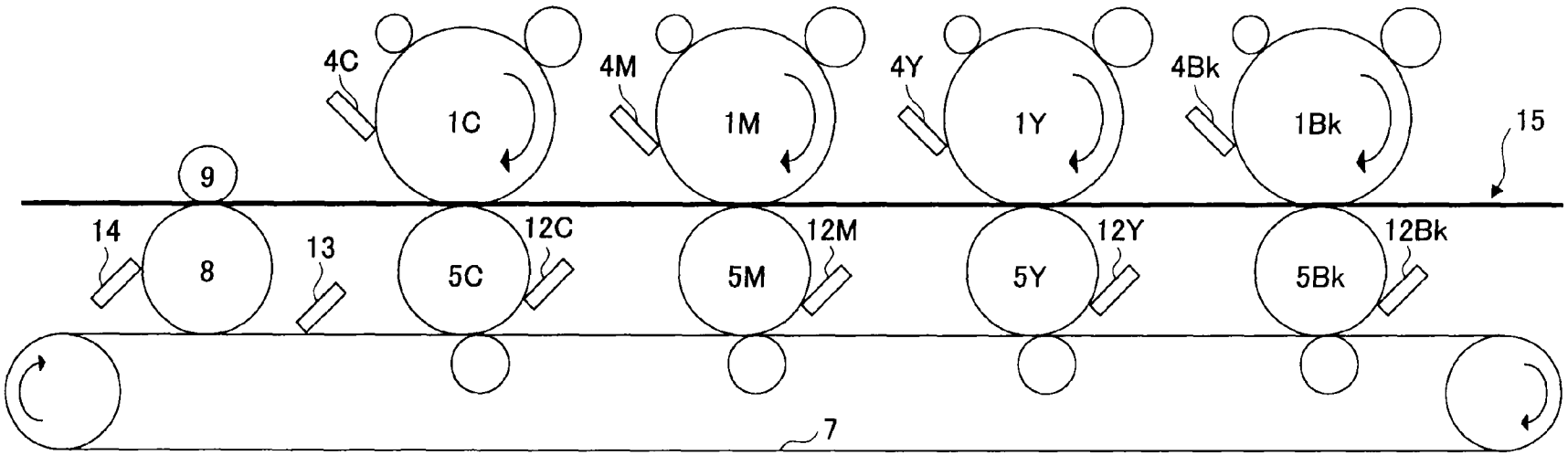
FIG. 2 shows a schematic diagram of an image forming apparatus according to another embodiment in which cleaning devices for intermediate transfer bodies are employed.

On the first transfer rollers 5Bk, 5Y, 5M, and 5C after passing the second transfer areas, residual toner that has not been transferred to the transfer belt 7 for the secondary transfer may remain attached. Such remaining toner may be removed by a cleaning device 12C, 12M, 12Y, or 12Bk for the first transfer rollers 5Bk, 5Y, 5M, and 5C (i.e., the first intermediate transfer body) that is disposed downstream of each second transfer area, as shown in FIG. 2. The cleaning devices 12C, 12M, 12Y, and 12Bk for the first intermediate transfer body may employ either a mechanical or an electrostatic cleaning method. The toner collected by the cleaning devices may be reused.

The transfer belt 7 has an appropriate electrical resistance condition for electrostatic transfer by the secondary transfer bias. Specifically, the transfer belt 7 is comprised of a belt substrate of a resin film or rubber with a thickness which may range from about 50 to about 1000 μm, on which a surface layer of a low surface-energy material may be coated as needed, so that the transfer belt 7 has an overall volume resistance value which may range from 106 to 1014 Ωcm. The transfer belt 7, as it is endlessly moved, passes the secondary transfer nip portions in the second transfer areas for Bk, Y, M, and C, successively. Thus, the four toner images for Bk, Y, M, and C on the first transfer rollers 5Bk, 5Y, 5M, and 5C are composed into a four-color toner image on the transfer belt 7.

Each of the four second transfer rollers 6Bk, 6Y, 6M, and 6C may be comprised of a metal roller or a central metal core coated with an electrically conductive rubber layer or sponge layer. The second transfer rollers 6Bk, 6Y, 6M, and 6C are supplied with a secondary transfer bias with the opposite polarity to that of the toner on the first transfer rollers 5Bk, 5Y, 5M, and 5C, by a power supply not shown.

As shown in FIG. 1, downstream of the second transfer areas along the direction in which the transfer belt 7 is moved, there is disposed a photosensor 11 as a toner image detection unit. The photosensor 11 is configured to detect the relative positional relationships and densities of the four colors of the four-color toner image on the transfer belt 7. Based on the relative positional relationships of the four-color toner image detected by the photosensor 11, a color matching adjustment is performed to adjust the color matching among the colors. Based on the density of each color of the four-color toner image, a density adjustment is performed to adjust the attached toner amount for each color.

With reference to FIG. 1, above left of the transfer belt 7, a third transfer roller (which is a third intermediate transfer body) 8 is installed. The third transfer roller 8 is disposed in contact with the transfer belt 7 so that it can rotate with the transfer belt 7. In the example shown in FIG. 1, the third transfer roller 8 rotates in the anticlockwise direction.

The third transfer roller 8 forms a tertiary transfer nip where it contacts the transfer belt 7. The position of the tertiary transfer nip corresponds to a third transfer area.

The third transfer roller 8 is supplied with a tertiary transfer bias with the opposite polarity from that of the toner on the transfer belt 7. The third transfer roller 8 has an appropriate electrical resistance condition for electrostatic transfer by the tertiary transfer bias. In the third transfer area, the four-color toner image formed on the transfer belt 7 is transferred onto the third transfer roller 8, functioning as the third intermediate transfer body, in a tertiary transfer.

Thus the visible four-color toner image formed on the transfer belt 7 is transferred onto the third transfer roller 8 for the tertiary transfer by the tertiary transfer nip in the third transfer area. After passing the tertiary transfer nip, there may remain residual toner on the transfer belt 7 that has not been transferred onto the third transfer roller 8 during the tertiary transfer. FIG. 2 schematically shows how such residual toner on the transfer belt 7 (second intermediate transfer body) may be removed.

As shown in FIG. 2, the residual toner on the transfer belt 7 may be removed by a cleaning device 13 that is disposed downstream of the second transfer areas. The cleaning device 13 may include a mechanical cleaner such as a cleaning blade, or an electrostatic cleaner. The toner collected by the cleaning may be reused; in the case of the four-color toner image, however, this may be generally not possible as the four colors of toner are mixed.

The image forming apparatus may further include a separating unit (not shown), such as a linkage mechanism, configured to separate the transfer belt 7 from the first transfer rollers 5Bk, 5Y, 5M, and 5C and the third transfer roller 8. In this way, the transfer belt 7 can be disengaged from the first transfer rollers 5C, 5M, 5Y, and 5Bk and the third transfer roller 8 except when they need to be engaged with each other during, e.g., double-sided printing, density adjustment, and/or color matching adjustment.

Still referring to FIG. 1, above the third transfer roller 8 there is located a fourth transfer roller 9, which is a fourth transfer unit, opposite the third transfer roller 8 across the transport path 15 of the transfer medium. The fourth transfer roller 9 is disposed in contact with the third transfer roller 8 so that they can rotate together.

In the embodiment shown in FIG. 1, the fourth transfer roller 9 rotates in the clockwise direction. The contacting of the third transfer roller 8 and the fourth transfer roller 9 forms a quaternary transfer nip. To the fourth transfer roller 9, a quaternary transfer bias of the opposite polarity to that of the toner on the third transfer roller 8 is applied. The position of the quaternary transfer nip corresponds to a fourth transfer area.

The fourth transfer roller 9 has an appropriate electrical resistance condition for electrostatic transfer by the quaternary transfer bias. In the fourth transfer area, the four-color toner image formed on the third transfer roller 8 is transferred onto the back side of the transfer medium transported along the transport path 15.

On the third transfer roller 8 after passing the quaternary transfer nip, there may be attached residual toner that has not been transferred onto the transfer medium back surface during the quaternary transfer. Such residual toner may be removed by a cleaning device 14 for the third transfer roller 8 that is disposed downstream of the fourth transfer area, as shown in FIG. 2. The cleaning device 14 may employ either a mechanical or electrostatic cleaning method.

Figure 3:
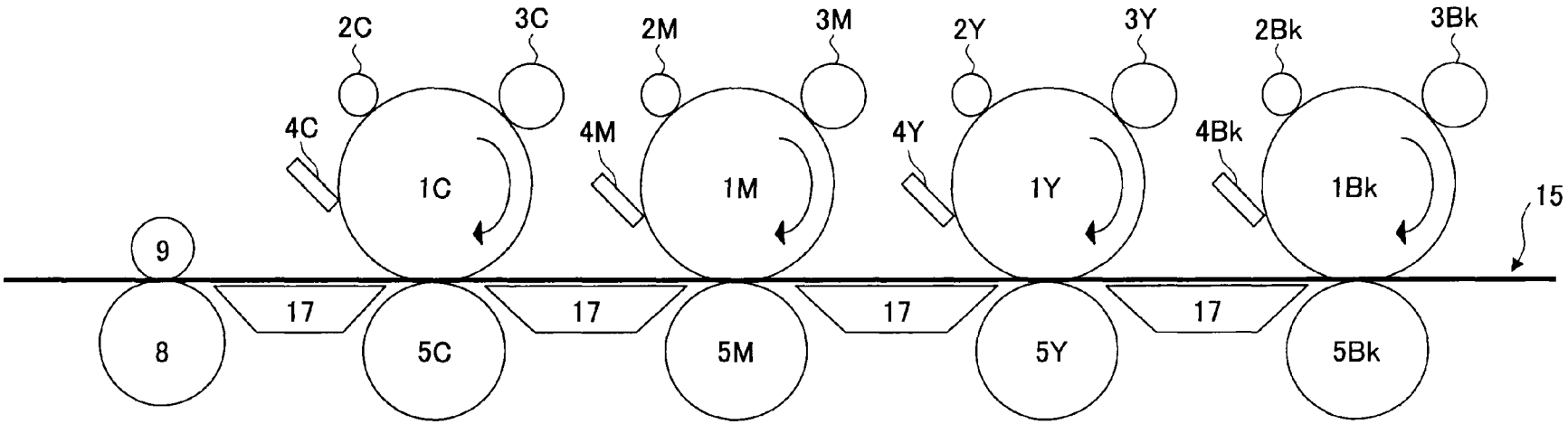
FIG. 3 shows a schematic diagram of an image forming apparatus according to another embodiment in which a transfer guide plate is provided under a transfer medium transport path.

The transfer medium with the toner image transferred on both sides thereof is further transported along the transport path 15 to a fusing device which is not shown in FIGS. 1 through 3.

Figure 4:
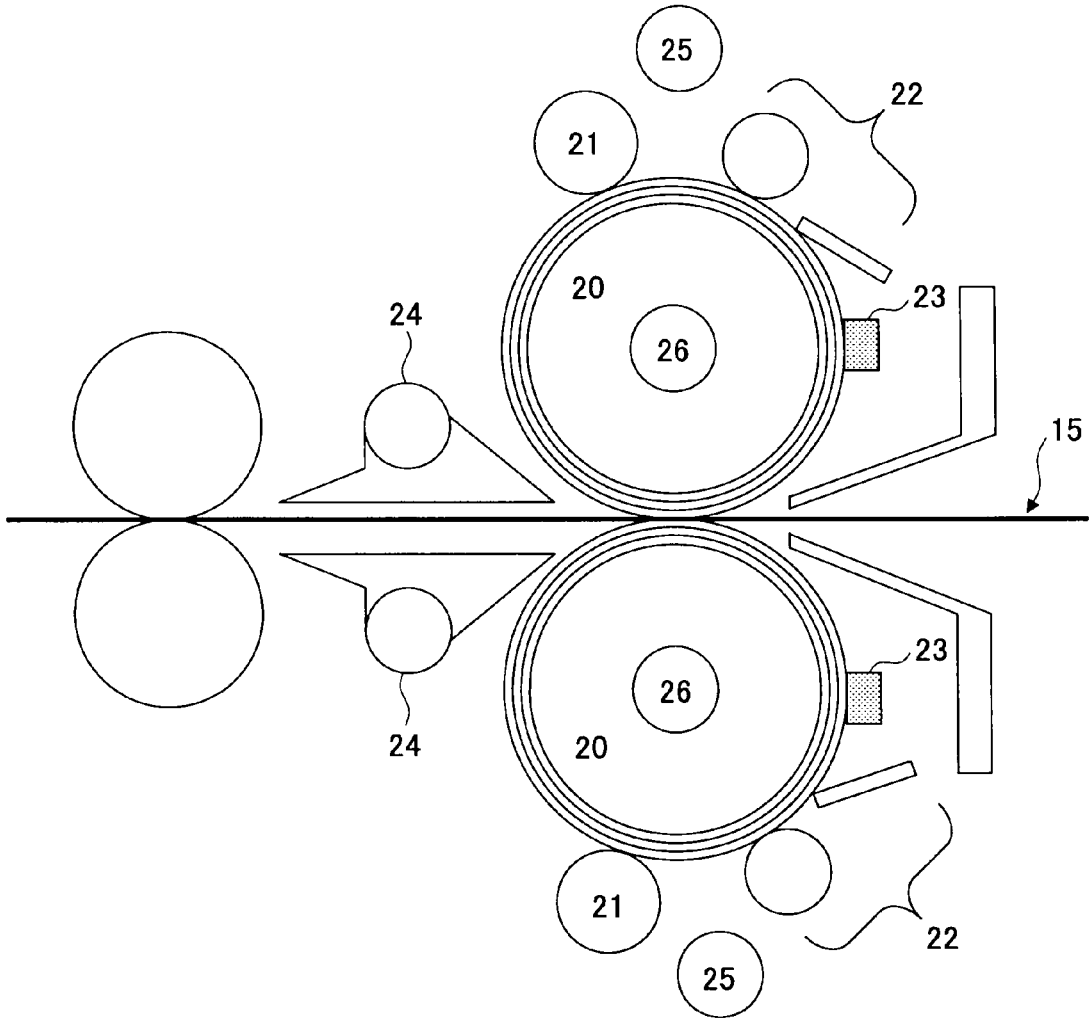
FIG. 4 shows a schematic diagram of a fusing device which may be used in the image forming apparatus according to any of the above embodiments of the present invention.

FIG. 4 shows an example of the fusing device. The fusing device is comprised of two fusing rollers 20. Each of the fusing rollers 20 has a heating unit 26, such as a halogen lamp, for heating both sides of the transfer medium at a fusing nip formed between the rollers 20. The heating softens the toner of the full-color image on either side of the transfer medium so that the image can be fused onto the transfer medium on either surface.

Thus, the full-color images on both sides of the transfer medium are fused at once by the single fusing operation. Thus, the heating of the toner is required only once, thereby avoiding the unwanted softening of toner which may cause blurring or toner peeling (toner offset). The fused transfer medium is then ejected out of the apparatus via ejection rollers or the like.

The surface temperature of each of the two fusing rollers 20 is detected by a temperature detection unit 23. Based on the surface temperature detected by the temperature detection unit 23, the power supply to the heating unit 26 in each fusing roller is controlled so that the surface temperature of each fusing roller 20 can be maintained in a certain range (target range).

In the case of single-sided printing in which an image is formed on one of the sides of the transfer medium, the image can be fused with less heat than required for double-sided printing. Thus, during single-sided printing, the target surface temperature range can be lowered from that for double-sided printing, whereby more energy can be saved.

Further, because a single-color image requires less toner than a full-color image, more energy can be saved by switching the target surface temperature range between single-color printing and full-color printing.

The transport path 15 is a linear and horizontal path along which the transfer medium moves while the toner image is transferred thereto. The leading edge of the transfer medium that has passed through the Bk primary transfer nip must be accurately transported to the Y primary transfer nip.

However, when the transfer medium lacks strength, such as in the case of a very thin sheet of paper, the transport force provided by the primary transfer nip for an individual color alone may not be sufficient. That is, the transfer medium may droop after passing through the previous primary transfer nip (such as the Bk primary transfer nip) and before entering the next primary transfer nip (such as the Y primary transfer nip) due to the weight of the transfer medium or the toner image on the transfer medium surface. If this happens, the transfer medium may fail to be transported into the next primary transfer nip (such as the Y primary transfer nip) properly.

Thus, as shown in FIG. 3, transfer guide plates 17, which are transfer aiding units, may be provided under the transport path 15 between the primary transfer nip portions for the individual colors and the quaternary transfer nip. By thus installing such transfer aiding units, the drooping of the transfer medium can be prevented, and the leading edge of the transfer medium can be reliably inserted into the downstream transfer nip portion along the transport path 15.

The transfer guide plate 17 may also be provided between a primary transfer nip and the fusing device under the transport path 15. The transfer aiding unit may be composed of a transport roller instead of the transfer guide plate.

With reference to FIG. 4, the structure of the fusing device is described in greater detail. Each of the pair of fusing rollers 20 has a metal core on which a layer of material with high mold-releasing property and small surface coarseness (such as RTV silicone rubber) is formed, making the surface very smooth. The core contains the heating unit 26.

Thus, even when a toner image made of color toners having a low softening temperature for better color reproducibility is formed on the transfer medium, the color toner image can be properly fused on both sides of the transfer medium without causing a toner offset on the fusing roller 20. Preferably, the surface coarseness of each fusing roller 20 is 4 μm or less in terms of the ten points average height Rz according to JIS (Japanese Industrial Standards), and more preferably on the order of 2 μm.

Around each fusing roller 20, there are disposed a cleaning member 21, an oil supply member 22, the aforementioned temperature detecting member 23, a removing nail 24, and an overtemperature preventing member 25. Thus in the fusing device of the present embodiment, the upper and lower fusing rollers 20 are made of the same components, and the various members surrounding them are interchangeable, thus reducing cost.

During single-sided printing, the fourth transfer area need not function. However, in the fourth transfer area, during single-sided printing, an unfused toner image on the front side of the transfer medium may contact the fourth transfer roller 9, whereby the toner image on the front side of the transfer medium may be disturbed. Thus, a separating unit capable of contacting and separating the fourth transfer roller 9 and the third transfer roller 8 may be provided. By separating the front side of the transfer medium from the fourth transfer roller 9 using the separating unit during single-sided printing, the disturbance of the toner image on the front side of the transfer medium can be prevented.

In the fourth transfer area, when the quaternary transfer bias with the opposite polarity to that of the toner is applied to the fourth transfer roller 9 during double-sided printing, the four-color toner image formed on the front side of the transfer medium may be reversely transferred to the fourth transfer roller 9, thereby disturbing the toner image on the front side of the transfer medium.

Thus, as shown in FIG. 1, a pre-fusing device 16 may be provided on the transfer medium transport path 15. The pre-fusing device 16 may be disposed between the first transfer nip of the most downstream of the first transfer rollers 5C, 5M, 5Y, and 5Bk, i.e., the first transfer roller 5C for cyan, and the fourth transfer nip between the third transfer roller 8 and the fourth transfer roller 9. Using the pre-fusing device 16, the toner image on the front side of the transfer medium can be preliminarily fused.

The pre-fusing device 16 only needs to be capable of preventing the reverse transfer of the toner image onto the fourth transfer roller 9 upon application of the quaternary transfer bias thereto. Thus, the target range of the surface temperature of the pre-fusing device 16, such as a pre-fusing roller, may be set low. Alternatively, the pre-fusing device 16 may be based on the application of pressure on the toner image on the transfer medium surface, instead of, or in combination with, the application of heat.

Alternatively, in the fourth transfer area, a contactless transfer charger may be used instead of the fourth transfer roller 9. In this way, the four-color toner image can be transferred onto the back side of the transfer medium for the quaternary transfer while preventing the disturbance in the toner image on the front side of the transfer medium without using the pre-fusing device 16.

During double-sided printing, first a toner image for the back side of the transfer medium is formed on the image carrier, i.e., the photosensitive drums 1Bk, 1Y, 1M, and 1C. The transport of the transfer medium along the transport path 15 is timed so that the transfer medium arrives at the fourth transfer area just when a four-color image reaches the fourth transfer area via the first transfer rollers 5Bk, 5Y, 5M, and 5C (first intermediate transfer body), the transfer belt 7 (second intermediate transfer body), and the third transfer roller 9 (third intermediate transfer body). In the fourth transfer area, the four-color toner image is transferred onto the back side of the transfer medium.

The double-sided printing sequence is timed so that the toner image for the front side of the transfer medium is transferred onto the front side of the transfer medium in the first transfer area after the toner image for the back side of the transfer medium has been formed and transferred from the image carrier onto the first intermediate transfer body. In this way, the positions of the toner images on both sides of the transfer medium are matched.

If a single toner image to be formed on the back side is very long in the vertical scan direction, the leading edge of the toner image may have reached the fourth transfer area when the rear portion of the toner image is still being formed on the image carrier (photosensitive drums). In this case, the formation of a toner image for the front side on the image carrier cannot be started at the proper timing time. If this happens, the positions of the toner images on the front and back sides of the transfer medium cannot be correctly matched.

Thus, a maximum sheet length L for an image that can be formed on the transfer medium back side in the vertical scan direction in the case of double-sided printing may be defined by:

$$L=L2-L1$$

where L1 is a distance between the first transfer area for Bk and the fourth transfer area along the transport path 15 of the transfer medium, and L2 is a distance between the first transfer area for Bk and the fourth transfer area along the transport path of the toner image.

The above maximum sheet length L in the vertical scan direction for double-sided printing may be stored in an internal memory in advance. Upon instruction from a user for double-sided print, a sheet length designated by the user is compared with L. If the designated length is greater than L, a print error message may be displayed or the image forming apparatus may be paused.

In the image forming apparatus according to an embodiment, the transfer of a toner image onto a front side of a transfer medium is directly conducted from the image carrier, while the transfer to a back side is conducted via three intermediate transfer bodies. Thus, a small and inexpensive image forming apparatus can be provided with which a high-quality image can be formed on both sides of the transfer medium.

In the image forming apparatus according to another embodiment, the angle of the transfer medium or its transport force upon entering a transfer area can be adjusted via a transfer guide plate or roller. Thus, the transfer medium can be transported to a nip portion between an image carrier and a first intermediate transfer body accurately without being influenced by the nature of the transfer medium.

In the image forming apparatus according to another embodiment, during single-sided printing, the fourth transfer roller 9 that contacts the toner image that is yet to be fused on the front side of the transfer medium can be separated from the transfer medium. Thus, degradation of the un-fused toner image by its contact with the fourth transfer roller 9 can be prevented.

In the image forming apparatus according to another embodiment, pre-fusing is performed after the transfer of a toner image onto the front side of the transfer medium. Thus, the reverse transfer of the toner image on the front side of the transfer medium onto the fourth transfer roller 9 can be prevented when a toner image is transferred onto the back side of the transfer medium.

In the image forming apparatus according to another embodiment, a toner image is transferred onto the back side of the transfer medium using a contactless transfer unit such as a transfer charger. Thus, the reverse transfer of the toner image on the front side of the transfer medium can be prevented.

In the image forming apparatus according to another embodiment, a toner cleaning unit such as a cleaning blade is employed on the first intermediate transfer body. Thus, the back staining on the back side of the transfer medium by a residual toner on the first intermediate transfer body can be prevented during the transfer of a toner image onto the front side of the transfer medium. Thus, degradation of the toner image by the residual toner can be prevented. Also, the recovered toner can be reused.

In the image forming apparatus according to another embodiment, a toner cleaning unit such as a cleaning blade is employed on the second intermediate transfer body. Thus, when a toner image is transferred onto the second intermediate transfer body, degradation of the toner image by the residual toner on the second intermediate transfer body can be prevented.

In the image forming apparatus according to another embodiment, a toner cleaning unit such as a cleaning blade is employed on the third intermediate transfer body. Thus, when a toner image is transferred onto the back side of the transfer medium, degradation of the toner image by the residual toner on the third intermediate transfer body can be prevented.

In the image forming apparatus according to another embodiment, during single-sided printing, the second intermediate transfer body may be separated from the first intermediate transfer body and the third intermediate transfer body. Thus, the back staining on the back side of the transfer medium by the residual toner on the second intermediate transfer body can be prevented.

In the image forming apparatus according to another embodiment, during a density adjustment or a color matching adjustment, the second intermediate transfer body may be separated from the first intermediate transfer body and the third intermediate transfer body. Thus, the density adjustment or the color matching adjustment can be easily carried out for the toner image on both the front side and the back side of the transfer medium.

In the image forming apparatus according to another embodiment, a difference between the moved distance of the toner image between the first transfer area and the fourth transfer area and the transport distance of the transfer medium between the first transfer area and the fourth transfer area may be stored in memory. Thus, the maximum sheet length for a double-sided printing can be determined, so that the problem of an abnormal image caused by the overlapping of toner images for the front and back sides of the transfer medium can be prevented.

Although this invention has been described in detail with reference to certain embodiments, variations and modifications exist within the scope and spirit of the invention as described and defined in the following claims.

The present application is based on the Japanese Priority Application No. 2008-015487 filed Jan. 25, 2008, the entire contents of which are hereby incorporated by reference.

What is claimed is:

1. An image forming apparatus comprising:

a latent image forming unit configured to form a latent image on an image carrier;

a developing unit configured to develop the latent image on the image carrier to form a toner image;

a first transfer unit configured to transfer the toner image on the image carrier onto a front side of a transfer medium, which includes the front side and a back side, when the transfer medium is in a first transfer area of a transport path of the transfer medium, and configured to serve as a first intermediate transfer body that transfers the toner image onto a second transfer unit when the transfer medium is not in the first transfer area;

the second transfer unit, which is configured to transfer the toner image from the first intermediate transfer body onto a second intermediate transfer body in a second transfer area;

a third transfer unit configured to transfer the toner image from the second intermediate transfer body onto a third intermediate transfer body in a third transfer area; and a fourth transfer unit configured to transfer the toner image from the third intermediate transfer body onto the back side of the transfer medium in a fourth transfer area, wherein each of the first intermediate transfer body and the third intermediate transfer body includes a roller, and the second intermediate transfer body includes a belt, and wherein the fourth transfer area is located downstream of the first transfer area along the transport path of the transfer medium.

2. The image forming apparatus according to claim 1, further comprising a plurality of first transfer areas; and a transfer aiding unit disposed between one of the plurality of first transfer areas and another of the plurality of first transfer areas, and/or between the first transfer area and the fourth transfer area, the transfer aiding unit being configured to aid transport of the transfer medium along the transport path.

3. The image forming apparatus according to claim 1, including a pre-fusing unit disposed between the first transfer unit and the fourth transfer unit along the transport path of the transfer medium.

4. The image forming apparatus according to claim 1, including a cleaning device configured to clean the first intermediate transfer body from which the toner image is transferred onto the second intermediate transfer body by the second transfer unit.

5. The image forming apparatus according to claim 1, including a cleaning device configured to clean the second intermediate transfer body from which the toner image is transferred onto the third intermediate transfer body by the third transfer unit.

6. The image forming apparatus according to claim 1, including a cleaning device configured to clean the third intermediate transfer body from which the toner image is transferred onto the transfer medium by the fourth transfer unit.

7. The image forming apparatus according to claim 1, including a toner image detection unit configured to detect a density and a transfer position of the toner image transferred onto the second intermediate transfer body.

8. An image forming method, comprising:

forming a latent image on an image carrier;

developing the latent image on the image carrier to form a toner image;

transferring the toner image on the image carrier onto a front side of a transfer medium, which includes the front side and a back side, when the transfer medium is in a first transfer area of a transport path of the transfer medium;

transferring the toner image onto a first intermediate transfer body when the transfer medium is not in the first transfer area;

transferring the toner image from the first intermediate transfer body onto a second intermediate transfer body in a second transfer area;

transferring the toner image from the second intermediate transfer body onto a third intermediate transfer body in a third transfer area; and transferring the toner image from the third intermediate transfer body onto the back side of the transfer medium in a fourth transfer area, wherein each of the first intermediate transfer body and the third intermediate transfer body includes a roller, and the second intermediate transfer body includes a belt, and wherein the fourth transfer area is located downstream of the first transfer area along the transport path of the transfer medium.

9. The image forming method according to claim 8, further comprising aiding the transfer medium to be transported along the transport path by disposing a unit between one of a plurality of first transfer areas and another of the plurality of first transfer areas, and/or between the first transfer area and the fourth transfer area.

10. The image forming method according to claim 8, further comprising separating the transfer medium from a transfer unit that transfers the toner image on the third intermediate transfer body onto the back side of the transfer medium in the fourth transfer area.

11. The image forming method according to claim 8, further comprising prefusing the toner image on the front side of the transfer medium.

12. The image forming method according to claim 8, further comprising cleaning the first intermediate transfer body from which the toner image is transferred onto the second intermediate transfer body.

13. The image forming method according to claim 8, further comprising cleaning the second intermediate transfer body from which the toner image is transferred onto the third intermediate transfer body.

14. The image forming method according to claim 8, further comprising cleaning the third intermediate transfer body from which the toner image is transferred onto the transfer medium.

15. The image forming method according to claim 8, further comprising separating the second intermediate transfer body from the first intermediate transfer body and the third intermediate transfer body.

16. The image forming method according to claim 8, further comprising detecting a density and a transfer position of the toner image transferred onto the second intermediate transfer body.

* * * * *